US005106662A

United States Patent [19]

Khayat

[11] Patent Number: 5,106,662

[45] Date of Patent: Apr. 21, 1992

[54] FLOWER WRAPPER

[76] Inventor: Kamil Khayat, 10535 Wilshire Blvd., Los Angeles, Calif. 90024

[21] Appl. No.: 597,533

[22] Filed: Oct. 15, 1990

[51] Int. Cl.[5] ..... B65D 85/50

[52] U.S. Cl. ..... 428/23; 24/5; 47/41.01; 206/423; 248/27.8; 428/34.1; 428/81; 428/542.8

[58] Field of Search ..... 206/423; 248/27.8; 24/5; 47/41.01, 41.15, 84; 428/23, 34.1, 81, 542.8

[56] References Cited

U.S. PATENT DOCUMENTS

| | | | |
|---|---|---|---|
| 1,707,896 | 4/1929 | Binley | 206/423 |
| 2,771,695 | 11/1956 | James | 248/27.8 X |
| 3,309,258 | 3/1967 | Gallo | 248/27.8 |
| 3,474,568 | 10/1969 | Gallo | 248/27.8 X |

*Primary Examiner*—Henry F. Epstein
*Attorney, Agent, or Firm*—Fred Flam

[57] ABSTRACT

A floral wrapper comprises a body of a flat board stock material having four score lines. These score lines extend longitudinally, and are spaced angularly about a center located beyond the lower end of the body. Four contiguous segments are thus defined. Notches extending inwardly from the sides of the outer segments extend at least to the outer score lines whereby the outer segments are divided into upper wings and lower wings independently foldable about their score lines. The lower wings may be folded one over the other and about the stems of flowers to form a holder therefor as well as a grip for the wrapper. The upper wings can assume a substantially flat or trough like orientation for display of a relatively wide floral presentation, or the upper wings can assume an orientation in which they, along with the lower wings are overlapped to form a three sided box configuration for enclosing a floral presentation. The notches form a seat for a tie or ribbon. The inner segments at the upper area of the wrapper may be provided with a window of suitable form.

7 Claims, 3 Drawing Sheets

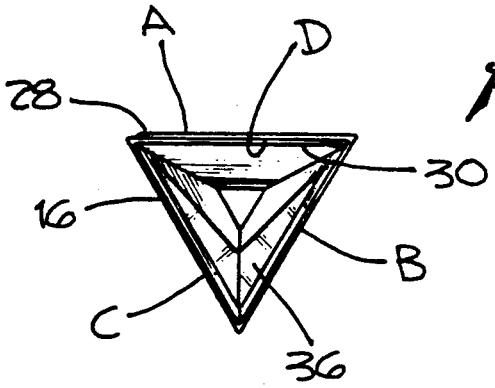
Fig. 6.
Fig. 1.
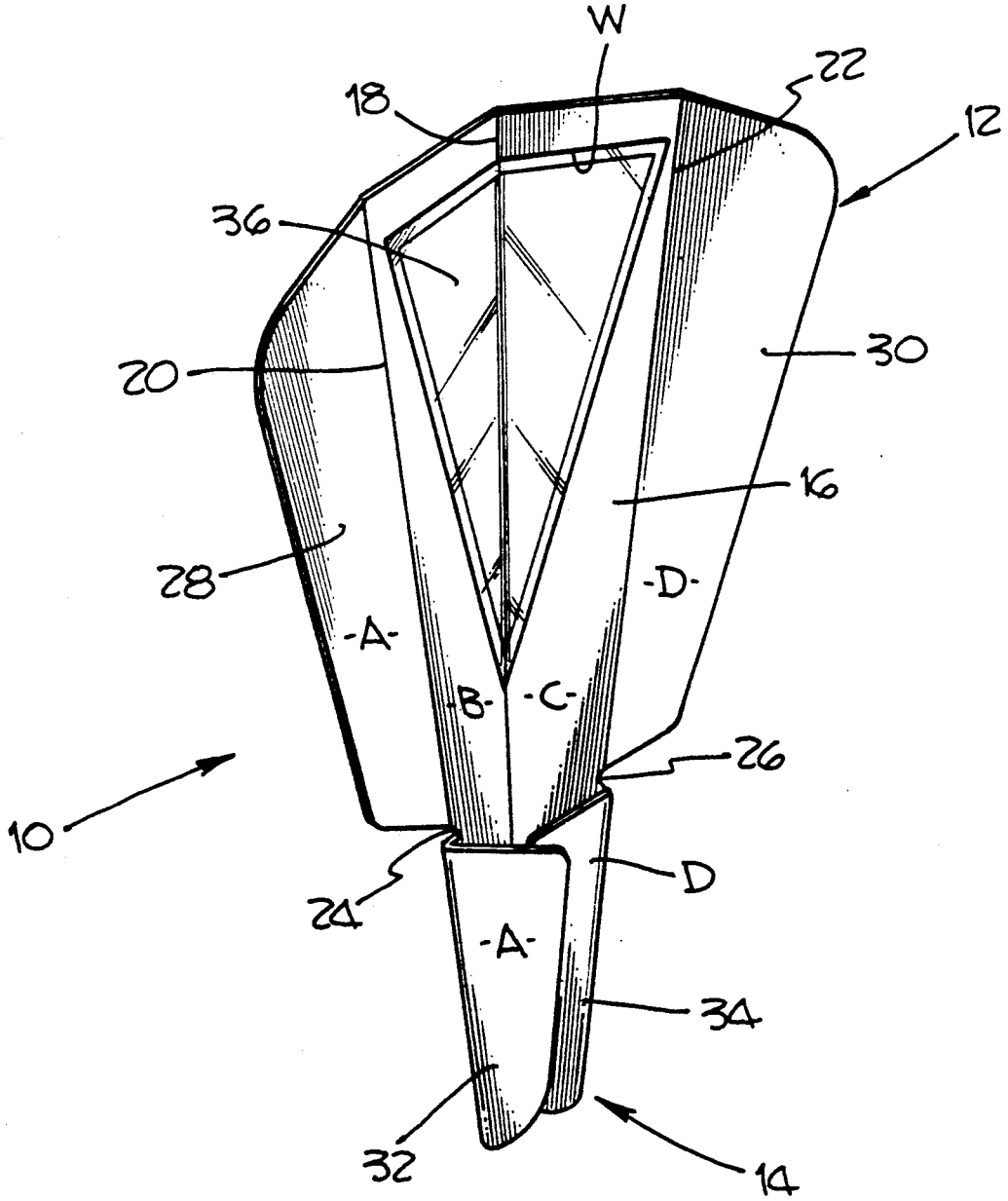

FLOWER WRAPPER

FIELD OF INVENTION

This invention relates to an ornamental package or wrapper for a bouquet of flowers or like designed especially for use by florists.

BACKGROUND OF THE INVENTION

The most economical way of wrapping or packaging a bouquet of flowers is to utilize a sheet of translucent or transparent plastic or other flexible sheet material. The sheet material is curled or rolled into the form of a cone and held by staples or other conventional fasteners. If the sheet material is effective to hold the bouquet, the bouquet may be crushed or bruised and its attractiveness upon presentation may be compromised.

Rectangular boxes are obviously unsuitable for fan shaped bouquets. Boxes are, however, used for slender floral presentations. For display purposes, windows are often provided. Compared to plastic sheet materials, boxes are cumbersome and expensive. Florists understandably disfavor stocking bulky boxes, and equally disfavor assembling them from flat die cut stock.

To provide an effective display package, florists will sometimes use a vase as part of the packaging of bouquet, with temporary protective sheet material extending upwardly from the vase. Maintaining an inventory of fragil vases has its disadvantages.

The object of the present invention is to provide a new and novel floral package or wrapper that can be stocked nested or flat, but which is easily configures to provide alternate package configurations. Another object of the present invention is to provide a package of this character that can provide a fan shaped support for a floral presentation or an rigid protective enclosure therefor. Yet another object of the present invention is to provide a wrapper or package of this character that provides a grip or handle at the bottom that, in the fan mode, secures the flower stems.

This invention possesses many other advantages, and has other objects which may be made more clearly apparent from a consideration of the preferred embodiment of the invention shown and described.

SUMMARY OF INVENTION

In order to accomplish the foregoing objectives, I provide a body of flat board material provided with three side-by-side score lines extending longitudinally from the top to the bottom of the body, and dividing the body into four contiguous segments. Die cut notches extend inwardly from the sides of the body at least to the two outer score lines respectively. The notches divide the body into an upper display area and a lower grip area, and also divide the outer segments into upper and lower wings independently foldable about their score lines. In one mode, the segments at the upper body area remain substantially flat or in slightly folded trough position to form a fan like backing for a floral presentation while the wings at the lower area are folded one over the other to encompass the stems of the flowers and to form a grip for the wrapper. In an alternate mode, the entire outer segment are folded one over the other as the inner segments bend towards each other, thereby forming a three sided funnel shaped enclosure for flowers. In both modes, the notches form a seat for a decorative tie or ribbon.

BRIEF DESCRIPTION OF THE DRAWINGS

A detailed description of the invention will be made with reference to the accompanying drawings wherein like numerals designate corresponding parts in the several figures. These drawings are true scale.

FIG. 1 a rear perspective view of a flower wrap incorporating the present invention shown in its fan position for receiving a bouquet of flowers.

FIG. 6 is a top plan view of the flower wrap as shown in FIGS. 2, 3 and 4 showing the triangular configuration of the wrapper.

DETAILED DESCRIPTION OF THE PREFERRED EMBODIMENT

The following detailed description is of the best presently comtemplated mode of carrying out the invention. The description is not to be taken in a limiting sense, but is made merely for purposes of illustrating the general principles of the invention, the scope of the invention being defined by the appended claims.

The flower wrapper 10 shown in FIG. 1 has upper display area 12 that forms a generally fan shaped backing for a grouping of flowers. The wrapper includes an integral lower area 14 that forms a grip or handle positioned to surround the stems of the flowers.

Figure 5:
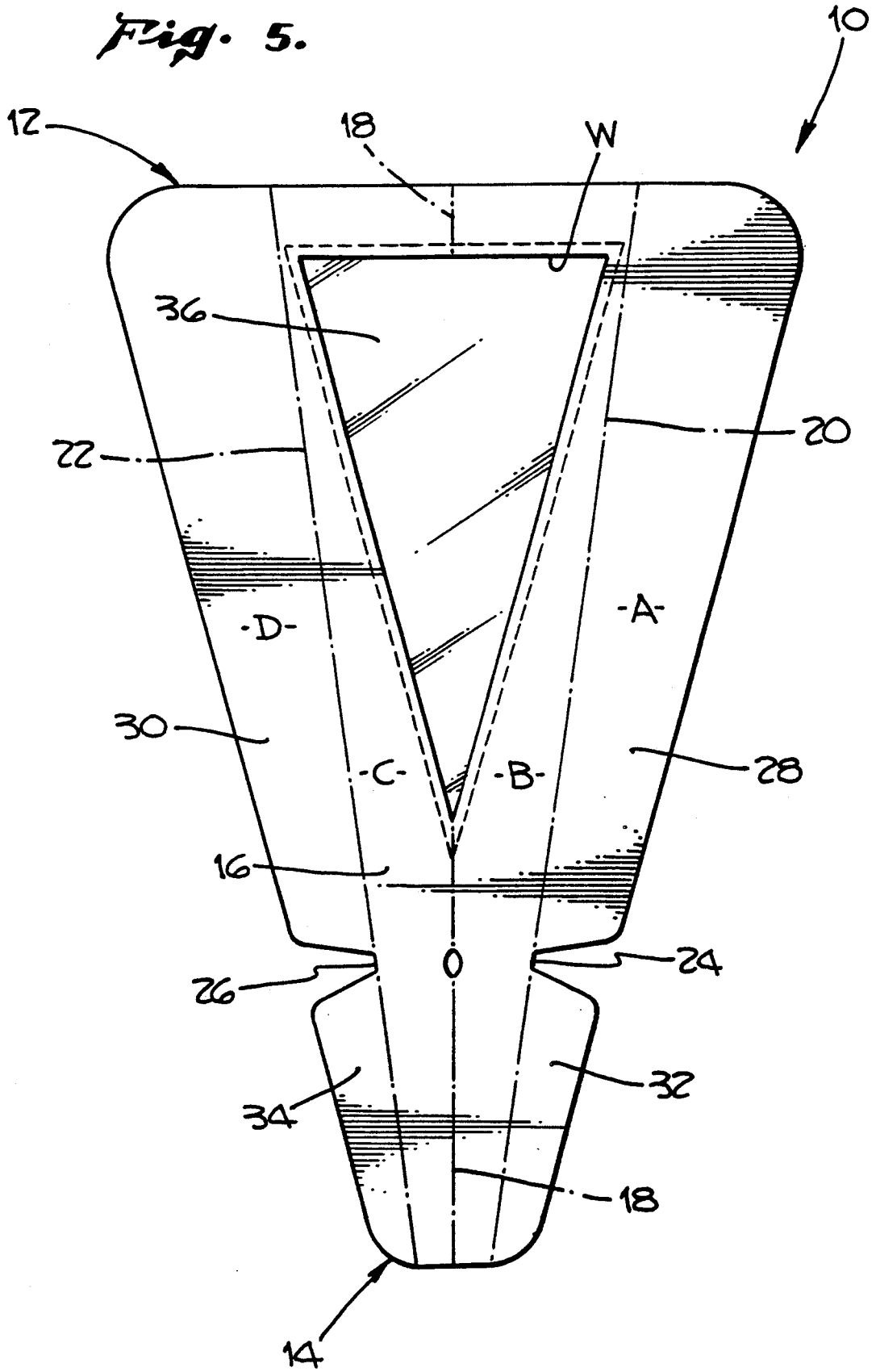
FIG. 5 is a front plan view of the flower wrap in its flat stack mode preparatory to use.

The wrapper body 16 (FIG. 5) is made of bendable die cut and scored board stock. The stock has a weight suitable to provide a reasonable measure of rigidity and support. The body has three score lines 18, 20 and 22 extending from top to bottom and defining four main segments A, B, C and D of the body 16 that are approximately of equal width. The score lines radiate from an imaginary center located well beyond the lower area 14. These angularly spaced score lines define a generally fan shaped configuration of the wrapper body.

Two die cut notches 24 and 26 extend inwardly from the opposite side edges of the body 10, and just slightly inwardly of the score lines 20 and 22. The notches 24 and 26 divide the body into the upper and lower areas of the wrapper, each area being provided with lower wings 32, 34, each independently bendable or foldable about its score line 20 or 22.

In the open display mode illustrated in FIG. 1, the upper wings 28 and 30 are very slightly folded inwardly, and the intermediate segments are slightly folded about the central score line 18. A shallow trough configuration is provided for a wide fan display of the floral presentation. The wings 32 and 34 are folded over each other and folded over to enclose the stems of the flowers. A staple or other fastening means (not shown) secures the wings 32 and 34 in tight overlapped position whereby a convenient grip is formed for the package. For floral materials having more massive stems, a modified wrapper can be provided in which extra segments are added to the wings 32 and 34.

Figure 2:
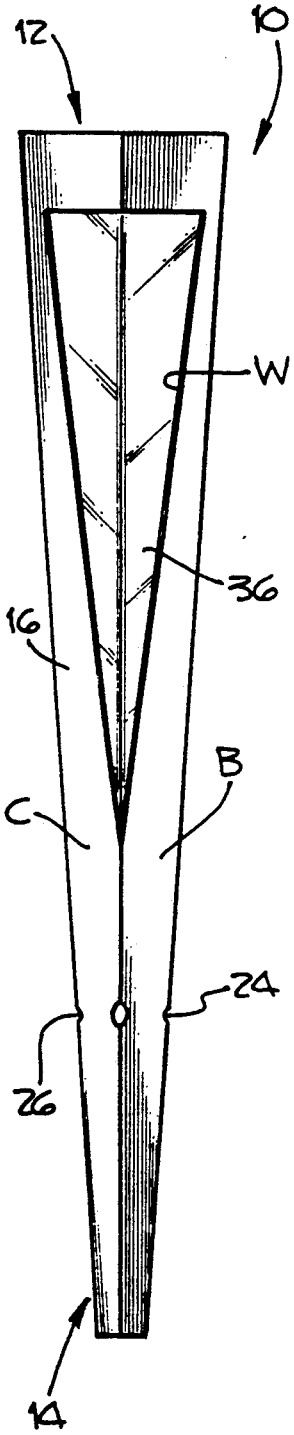
FIGS. 2, 3 and 4 are, respectively, front, side and rear elevational views of the flower wrap shown in an alternate box position for enclosing a floral presentation.
Figure 3:
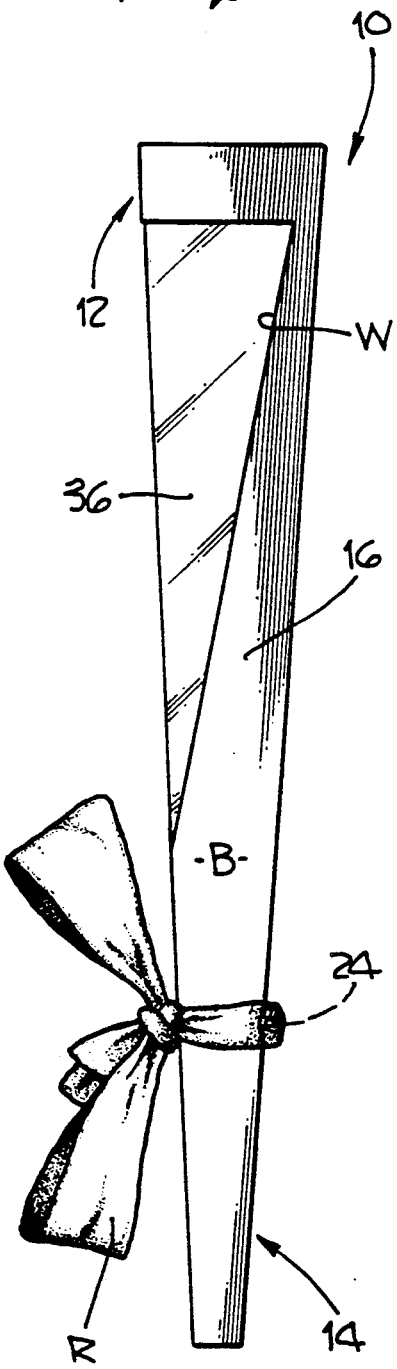
Figure 4:
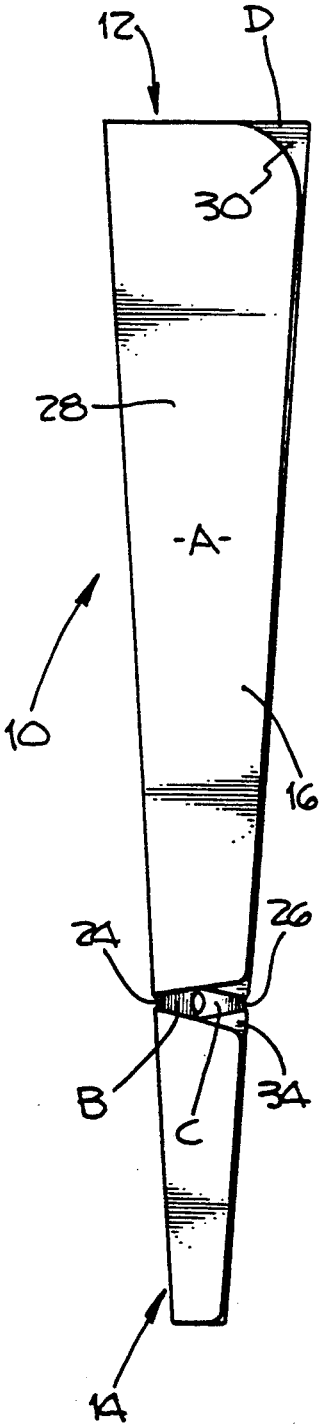

The wrapper can be used in an alternate mode in which the floral presentation is enclosed in a box like structure, as shown in FIGS. 2, 3 and 4. In this instance, the outer segments A and D of the wrapper body 10 are completely overlapped (top and bottom wings as a unit) and secured by suitable means (not shown) to form one side of a three sided enclosure. Once secured, the three sided configuration is stable and resists folding about any score line, which contrasts with a four sided configuration.

A window W is cut in the inner segments B and C whereby the floral presentation may be viewed. The window can take any suitable decorative form suggestive, perhaps, of an occasion. The window W is closed by a protective transparent plastic film 36 (FIG. 1) adhered about the edges on the inside of the window W.

In the both the open fan mode and the closed box mode, the notches 24 and 26 form a seat for placement of a tie. In FIG. 3, a ribbon R forms the tie. The notches stabilize the tie longitudinally; and, in the mode shown in FIGS. 2, 3, and 4, the tie assists in holding the wrapper in its folded position.

Before being configured to fan or box shape, the wrappers can be nested or stacked for convenience. The wrappers can be made in various sizes and shapes.

Intending to claim all novel, useful and unobvious features and combinations of features shown and/or described, I claim:

1. For use with one or a bunch of cut flowers, the combination therewith of:

(a) a body made of thin flat bendable stock material having an upper display area and a lower grip area;

(b) said body having a first series of score lines dividing said upper display area into a series of at least four side-by-side elongated segments foldable from an open display mode in which said upper area forms a backing fan for a floral presentation, to an closed box enclosure mode in which the end segments are overlapped;

(c) said body having a second series of score lines dividing the lower grip area into a series of side-by-side segments foldable to surround the stems of flowers to form a grip for said wrapper.

2. The combination as set forth in claim 1 together with means forming a window in said upper display area of said body, and a translucent sheet covering said window with the edges adhered about said window whereby the floral presentation is visible when said wrapper is in its said closed box mode.

3. The combination as set forth in claim 1 in which said body has transverse cuts or notches extending inwardly from the sides of said body and dividing said body into said upper display area and said lower grip area respectively; said cuts or notches forming a seat for a decorative tie circumscribing the body and located at said notches whereby said tie is axially stabilized and secured.

4. The combination as set forth in claim 1 in which said score lines radiate from an imaginary center located beyond said grip area thereby to form a fan configuration.

5. For use with one or a bunch of cut flowers. the combination therewith of;

(a) a body made of thin flat bendable material;

(b) said body having a series of three score lines extending longitudinally of the body and angularly spaced from each other about a center located beyond the lower end of said body; said score lines dividing said body into four side-by-side segments;

(c) said body having a pair of notches extending inwardly from the sides of the outer segments and extending to the outer score lines respectively to form thereby an upper display area of said wrapper and a lower grip area of said wrapper, and separating said outer segments into wings independently foldable about their score lines;

(d) said wings of lower grip area being foldable one over the other to form, when secured, a grip for said wrapper;

(e) said wings of said upper display area being selectively foldable from a wide display mode to an overlapped mode to form a three sided enclosure for a floral presentation therein.

6. The combination as set forth in claim 5 in which said notches form a seat for stabilizing a tie circumscribing said wrapper.

7. The combination as set forth in claim 5 in which the inner segments are provided with a window for view of the floral presentation when said wrapper is in its overlapped mode.

* * * * *